US006049164A

United States Patent [19]

Van Kemenade et al.

[11] Patent Number: 6,049,164

[45] Date of Patent: Apr. 11, 2000

[54] LOW-PRESSURE MERCURY LAMP WITH SPECIFIC ELECTRODE SCREENS

[75] Inventors: Wilhelmus M. P. Van Kemenade; Pieter J. C. Van Der Wel, both of Eindhoven, Netherlands

[73] Assignee: U.S. Philips Corporation, New York, N.Y.

[21] Appl. No.: 09/047,683

[22] Filed: Mar. 25, 1998

[30] Foreign Application Priority Data

Mar. 27, 1997 [EP] European Pat. Off. ..... 97200921

[51] Int. Cl.[7] ..... H01J 1/62

[52] U.S. Cl. ..... 313/492; 313/483; 313/485; 313/491

[58] Field of Search ..... 313/492, 491, 313/484, 485, 483, 490

[56] References Cited

U.S. PATENT DOCUMENTS

| | | | |
|---|---|---|---|
| 3,906,284 | 9/1975 | Franck et al. | 313/490 |
| 4,032,813 | 6/1977 | Shurgan et al. | 313/492 |
| 4,032,814 | 6/1977 | Shurgan et al. | 313/492 |
| 4,891,551 | 1/1990 | Will et al. | 313/492 |
| 5,004,949 | 4/1991 | Latassa et al. | 313/492 |
| 5,668,448 | 9/1997 | Montie et al. | 315/382 |
| 5,686,795 | 11/1997 | Sakoske et al. | 313/613 |
| 5,801,482 | 9/1998 | Verhaar et al. | 313/483 |

*Primary Examiner*—Vip Patel
*Assistant Examiner*—Matthew Gerike
*Attorney, Agent, or Firm*—F. Brice Faller

[57] ABSTRACT

A discharge vessel (10) encloses a discharge space (12) in a gastight manner, electrodes (21*a*, 21*b*) being arranged in the space and having a first (22*a*, 22*b*) and a second fastening (22*a*', 22*b*'). At least one of the electrodes (21*a*) is surrounded by a screen (23) which has a smallest width W, in a plane transverse to the tube axis (11) and transverse to the direction from the first (22*a*) to the second fastening (22*a*'), which width is smaller than the distance D between the fastenings (22*a*, 22*a*'). The screen (23*a*) has a length L in the direction of the tube axis (11) which lies between once and three times the smallest width W. The lamp consumes comparatively little mercury in the case of cold ignition.

8 Claims, 2 Drawing Sheets

LOW-PRESSURE MERCURY LAMP WITH SPECIFIC ELECTRODE SCREENS

BACKGROUND OF THE INVENTION

The invention relates to a low-pressure mercury discharge lamp provided with a tubular discharge vessel having a tube axis and enclosing a discharge space containing a filling of mercury and at least one inert gas in a gastight manner. Current supply conductors extend from outside the discharge vessel to electrodes arranged inside the discharge vessel, which electrodes each have a first and a second fastening. At least one of said electrodes is surrounded by a screen which has a smallest width W, transverse to the direction from the first to the second fastening, and in a plane transverse to the tube axis, which width is smaller than a distance D between said fastenings.

Such a low-pressure mercury discharge lamp, also referred to as lamp hereinafter, is known from U.S. Pat. No. 4,891,551. The discharge vessel has an electrode on either side in a commercially available lamp of this type. Each of the electrodes is surrounded by a screen having a smallest width W of 7 mm and a length L of 5 mm. The electrodes are fastened to their current supply conductors, the distance D between the first and the second fastening being 10 mm. Such lamps may be integrated with a supply unit so as to form a lighting unit, or alternatively it may be possible for them to be detachably coupled to a supply unit. A supply unit which ignites the lamp in the cold state is attractive on account of its simplicity. Moreover, the lamp emits light immediately in the case of cold ignition. It was found, however, that the known lamp consumes much mercury in the case of cold ignition. This is particularly disadvantageous in applications where the lighting unit is switched on frequently. Mercury consumption is here understood to be the phenomenon that mercury from the discharge space is bound during lamp life, so that it is no longer available for the discharge.

SUMMARY OF THE INVENTION

It is an object of the invention to provide a low-pressure mercury discharge lamp which consumes comparatively little mercury in the case of cold ignition.

According to the invention, surrounding the electrode the screen has a length L, in the direction of the tube axis, which lies between one and three times the smallest width W.

The inventors have experimentally ascertained that a length L within the range results in a considerable decrease in the mercury consumption in the case of cold ignition. This is surprising, the more so as the length L of the screen was found to have no appreciable influence during nominal operation. A possible explanation is the following: many metals, for example Ca, Sr, and Ba whose oxides are used in emitter materials for electrodes are capable of forming amalgams with mercury. Reduction of these oxides to the respective metals is found to take place in practice, for example during activation of the electrodes. Zr, which is often used as an additive in emitter material, also is an amalgam-forming metal. Mercury bound to such metals on the electrode is released again during lamp operation, when the electrodes are hot. In particular during cold ignition of the lamp, however, electrode material with any amalgam-forming metals present therein is sputtered off the electrodes. In the lamp according to the invention, with the screen length lying in the range defined above, much of this electrode material is captured by the screen. On the other hand, this screen becomes sufficiently hot during lamp operation for releasing the major portion of the mercury bound to electrode material also in this location. A screen having a length L greater than three times the smallest width W more loses heat owing to radiation, so that it assumes a too low temperature, which hampers the release of mercury. If the length L is smaller than the smallest width W, much electrode material will end up on the wall of the discharge vessel. Mercury bound to electrode material in this location is released to a very limited extent only on account of the comparatively low temperatures in situ.

A practical embodiment of the low-pressure mercury discharge lamp according to the invention is characterized in that the ratio L/W of the screen lies between 1.2 and 2.5. The reduction in the mercury consumption is comparatively limited for a ratio below 1.2. For a ratio above 2.5, no appreciable further reduction in the mercury consumption is realized, while the screen darkens the discharge vessel locally.

To achieve a compact construction, the circumference of the screen is preferably at most four times the distance D.

The most favourable results are obtained with an embodiment of the lamp according to the invention wherein each of the electrodes has a screen as described above.

The electrodes of the lamp according to the invention may each have only a single current supply conductor in the case of cold ignition. In this embodiment, the electrodes may have a first fastening to the current supply conductor and a second fastening to a wire fused into the wall of the discharge vessel. Preferably, to render possible operation with a hot-igniting supply unit, or to render possible an additional heating of the electrodes during operation, the electrodes each have a first and a second current supply conductor, to which they have their respective first and second fastenings. The electrodes may have additional fastenings between the first and the second fastening.

Factors other than those mentioned above are found to have a prevailing influence on the mercury consumption in the case of a hot-igniting supply unit and/or in the case of comparatively long operating times between switching-on and switching-off of the lamp. To reduce the mercury consumption also under these operating conditions, favourable embodiment of the low-pressure mercury discharge lamp according to the the discharge vessel can be provided with a protective layer at an inner surface. Such a protective layer, for example made from a metal oxide such as aluminum oxide or yttrium oxide, counteracts reactions between mercury and the discharge vessel wall. It also contributes to the maintenance of the luminous flux during lamp life. The end portions of the discharge vessel may also be provided with a protective layer.

The discharge vessel may have a luminescent layer for converting UV radiation into visible radiation, for example in lamps for general lighting purposes, or for converting UV radiation into UV radiation of greater wavelength, for example in suntanning lamps. Alternatively, a luminescent layer may be absent, for example in lamps for disinfection purposes.

DETAILED DESCRIPTION OF THE PREFERRED EMBODIMENTS

Figure 1:
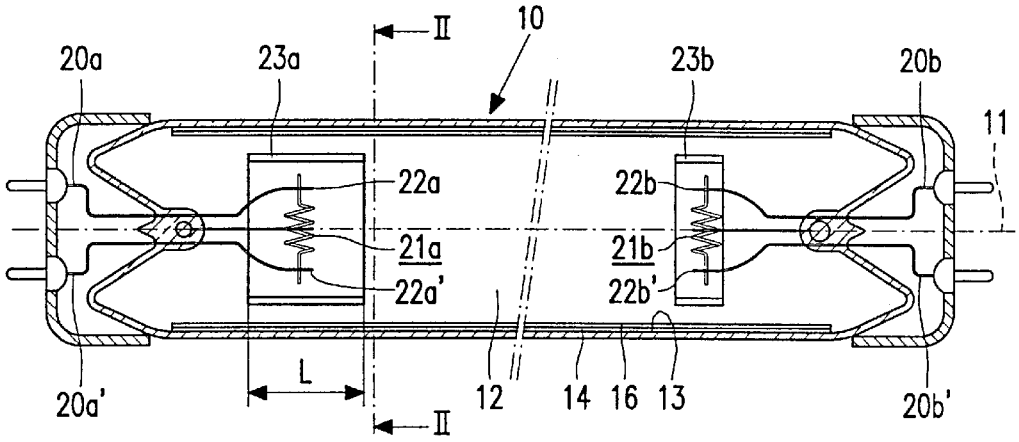
FIG. 1 shows a low-pressure mercury discharge lamp according to the invention.
Figure 2:
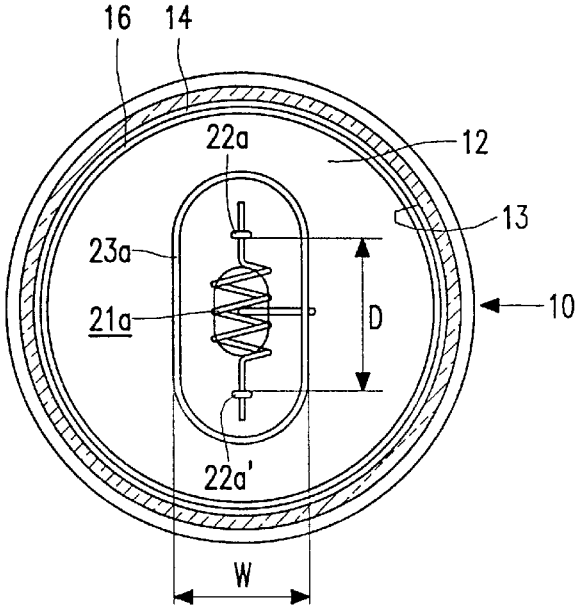
FIG. 2 is a cross-section taken on the line II—II in FIG. 1.

FIGS. 1 and 2 show a low-pressure mercury discharge lamp, here for general lighting purposes, provided with a tubular discharge vessel 10 having a tube axis 11. The discharge vessel 10 has a length of 120 mm and an inner diameter of 25 mm. The discharge vessel 10 encloses in a gastight manner a discharge space 12 which contains a filling of 1 mg mercury and a mixture of argon and krypton (25/75 vol %) with a filling pressure of 2 mbar. Current supply conductors 20*a*, 20*a*', 20*b*, 20*b*' extend from outside the discharge vessel 10 through end portions 17*a*, 17*b* of the discharge vessel to a first and a second electrode 21*a*, 21*b* arranged in the discharge space. In the embodiment shown, the electrodes 21*a*, 21*b* each have a first current supply conductor 20*a*, 20*b* and a second current supply conductor 20*a*', 20*b*' to which they have respective first fastenings 22*a*, 22*b* and second fastenings 22*a*', 22*b*'. The electrodes 21*a*, 21*b* are coated with an emitter material which comprises barium oxide, strontium oxide, and calcium oxide. The electrodes 21*a*, 21*b* are each surrounded by a screen 23*a*, 23*b*, made of iron in the present case. The screens 23*a*, 23*b* in the lamp shown, identified with "inv1" hereinafter, have a smallest width W of 7 mm transverse to the direction from the first fastening 22*a*, 22*b* to the respective second fastening 22*a*', 22*b*' and in a plane transverse to the tube axis 11. The smallest width W of the screens 23*a*, 23b is smaller than the distance D between the fastenings of the electrode, which is 10 mm. The screens 23*a*, 23*b* have a circumference of 36 mm, which is less than four times the distance between the fastenings. The screen 23*a* of the first electrode 21*a* has a length L of 15 mm in the direction of the tube axis 11, ie 2.14 times the smallest width W. The length L thus lies between once and three times the smallest width W. In particular, the ratio L/W lies between 1.2 and 2.5. The length L of the screen 23*b* of the second electrode 21*b* is 5 mm. The discharge vessel has a protective layer 14 of finely distributed aluminum oxide with a coating weight of 55 $\mu g/cm^2$ on its inner surface. The aluminum oxide particles of the protective layer have a median diameter of approximately 0.013 $\mu m$, and a specific area of approximately 100 $m^2/g$. In the embodiment shown, the protective layer 14 is provided directly on the inner surface 13 of the discharge vessel 10. In an alternative embodiment, the protective layer is supported by a layer repelling alkali metals, for example made of silicon oxide. A layer repelling alkali metals counteracts the migration of alkali metals, such as sodium, from the discharge vessel wall into the discharge space, where they will form amalgams with mercury, or lead to mercury consumption in some other way. The protective layer 14 here supports a luminescent layer 16 with a coating weight of 1.8 $mg/cm^2$ which is composed of a mixture of green-luminescing cerium-magnesium aluminate activated by terbium, blue-luminescing barium-magnesium aluminate activated by bivalent europium, and red-luminescing yttrium oxide activated by trivalent europium.

In an endurance test, the mercury consumption was measured for the lamp "inv1" according to the invention as described above, for a further lamp "inv2" according to the invention, and for a lamp "ref" not according to the invention. Both electrodes in lamp inv2 have a screen of 10 mm length. Both electrodes of lamp ref have a screen of 5 mm length. The ratio L/W of the screens of the lamps inv2 and ref is accordingly 1.43 and 0.71, respectively. The lamps inv2 and ref correspond to the lamp inv1 in all respects other than those mentioned.

Figure 3:
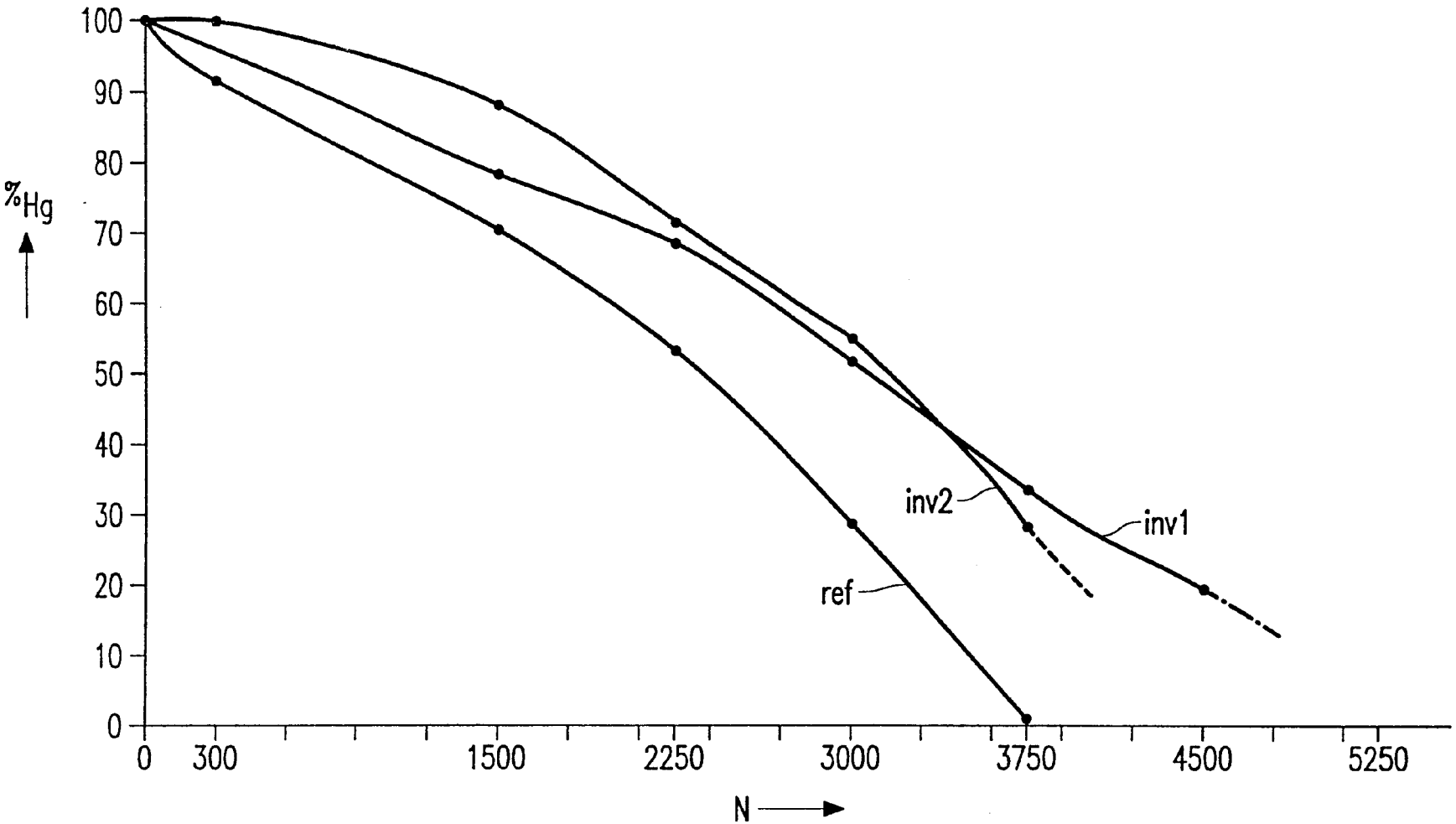
FIG. 3 shows the percentage of free mercury ($\%_{Hg}$) as a function of the number of switching-on operations (N).

The lamps were operated at high frequency by means of a supply unit which ignites in the cold state during the endurance test. The lamps were switched on for 15 min and off for 5 min periodically during this test. The mercury consumption as a function of the number of switching-on operations was ascertained by the method described in EP 725 977, to which U.S. Pat. No. 5,668,448 corresponds the displacement of free mercury during DC operation being measured. The remaining percentage by weight of free mercury ($\%_{Hg}$) as a function of the number of cold ignition operations (N) is plotted in FIG. 3. It is apparent from FIG. 3 that the mercury present in the discharge space of lamp ref has been substantially used up after 3750 switching-on operations. A substantial portion of the mercury was still free for lamp operation at that moment in the lamps inv1and inv2 according to the invention.

The lamps according to the invention were also found to consume comparatively little mercury compared with lamps not according to the invention in the case of dimmed operation, where the current through the discharge space is reduced. The mercury consumption of lamps according to the invention and lamps not according to the invention is approximately the same during nominal operation.

We claim:

1. A low-pressure mercury discharge lamp provided with a tubular discharge vessel (10) having a tube axis (11) and enclosing a discharge space (12) containing a filling of mercury and one or several rare gases in a gastight manner, current supply conductors (20*a*, 20*a*', 20*b*, 20*b*') extending from outside the discharge vessel to electrodes (21*a*, 21*b*) arranged inside the discharge vessel, which electrodes each have a first (22*a*, 22*b*) and a second fastening (22*a*', 22*b*'), while at least one of said electrodes (21*a*) is surrounded by a screen (23*a*) which has a smallest width W, transverse to the direction from the first to the second fastening and in a plane transverse to the tube axis and, which width is smaller than a distance D between said fastenings, characterized in that the screen (23*a*) has a length L, in the direction of the tube axis, which lies between 1.2 and 2.5 times the smallest width W.

2. A low-pressure mercury discharge lamp as claimed in claim 1, wherein the circumference of the screen (23*a*) is at most four times the distance D.

3. A low-pressure mercury discharge lamp as claimed in claim 1 wherein each of the electrodes has a screen relevant claim.

4. A low-pressure mercury discharge lamp as claimed in claim 1 wherein the discharge vessel (10) is provided with a protective layer (14) at an inner surface (13).

5. A low pressure mercury discharge lamp comprising a tubular discharge vessel having a tube axis and enclosing a gastight discharge space having a filling of mercury and at least one inert gas, a pair of electrodes situated inside said discharge space, each electrode being connected to pair of current supply conductors by a first fastening and a second fastening separated by a distance D, said current supply conductors extending to outside said discharge vessel, a screen surrounding at least one of said electrodes, said screen having a circumference which is at most four times D, said screen having a length L parallel to the tube axis and a smallest width W transverse to said axis and transverse to the direction from the first to the second fastening, wherein W is less than D, and L is one to three times W.

6. A low-pressure mercury discharge lamp as in claim 5 wherein L is 1.2 to 2.5 times W.

7. A low-pressure mercury discharge lamp as in claim 5 wherein one of said screens surrounds each of said electrodes.

8. A low-pressure mercury discharge lamp as in claim 5 wherein said discharge vessel has an inner surface provided with a protective layer.

* * * * *